United States Patent [19]

Woodruff

[11] 4,272,227

[45] Jun. 9, 1981

[54] VARIABLE DISPLACEMENT BALANCED VANE PUMP

[75] Inventor: Frank Woodruff, New Hartford, N.Y.

[73] Assignee: The Bendix Corporation, Teterboro, N.J.

[21] Appl. No.: 23,812

[22] Filed: Mar. 26, 1979

[51] Int. Cl.[3] ..... F04B 49/02; F04C 2/00; F04C 15/02

[52] U.S. Cl. ..... 417/440; 418/185

[58] Field of Search ..... 417/310, 440; 418/159, 418/185, 183, 184

[56] References Cited

U.S. PATENT DOCUMENTS

| | | | |
|---|---|---|---|
| 1,482,807 | 2/1924 | Newberg | 418/159 |
| 3,120,814 | 2/1964 | Mueller | 417/310 |
| 3,295,752 | 1/1967 | Bellmer | 417/310 |
| 3,515,496 | 6/1970 | Eddy | 417/440 |
| 4,022,551 | 5/1977 | Hirosawa | 417/440 |

*Primary Examiner*—John J. Vrablik

*Attorney, Agent, or Firm*—Anthony F. Cuoco; William F. Thornton

[57] ABSTRACT

A variable displacement balanced vane pump includes an alternate flow passage for fluid being compressed in an intervane chamber whereby the excess portion of the fluid is by-passed from the pump discharge zone to the pump inlet zone without appreciably increasing the pressure of the excess fluid portion to minimize the required pump input energy.

2 Claims, 6 Drawing Figures

VARIABLE DISPLACEMENT BALANCED VANE PUMP

FIELD OF THE INVENTION

This invention relates to fluid pumps and particularly to variable displacement balanced vane pumps. More particularly, this invention relates to pumps of the type described having an alternate fluid flow passage from the pump discharge zone to the pump inlet zone which minimizes the pump input energy.

DESCRIPTION OF THE PRIOR ART

High pressure vane pumps for aircraft applications and the like must be designed with size and weight requirements in mind. This is accomplished by providing a "balanced rotor" arrangement. That is to say, bearing loads are eliminated by an even number of lobes (usually two) on a cam ring so that any diametral line through the axis of the pump bisects the pump into two "mirror image" halves. This balances the radial forces on the pump rotor journal bearings, with the sum of such forces thereupon being zero.

Most variable displacement vane pumps known in the art utilize a single lobe cam ring design. Usually a circular transfer cylinder which provides zero fluid flow when concentric with the pump rotor and maximum fluid flow when displaced to its position of maximum eccentricity is employed. Under these conditions, massive bearings are required to sustain the rotor reaction forces under high discharge pressure conditions as are likely to occur.

Heretofore, efforts to develop a variable displacement balanced vane pump have featured a deformable cam ring. The cam ring is made flexible by using a laminated construction, and is distorted from a perfectly circular form to an elliptical form, with the amount of distortion governing the pump's displacement. An arrangement of this type has obvious disadvantages which have not been satisfactorily solved.

A variable fluid timing arrangement has been used wherein the reaction forces on the cam ring require an excessively large actuator and the internal leakage is necessarily high as port plates must be free to move relative to the cam ring, hence necessitating a discrete clearance between the port plates and the cam ring.

Other designs for variable displacement balanced vane pumps have been attempted but none have been satisfactory so as to provide a variable displacement balanced vane pump which is in common use.

SUMMARY OF THE INVENTION

This invention contemplates a variable displacement balanced vane pump including a rotor which rotates in a cam ring and a plurality of radially extending vanes. Check valves are built into the rotor between the vanes to permit fluid flow radially inward to an annular discharge port formed in port plates. In one embodiment of the invention, an alternate flow passage for fluid compressed in an inter-vane chamber is provided by holes extending through the cam ring which open to by-pass ports carried by a rotatable control ring in close diametrical fit with the outside diameter of the cam ring. In another embodiment of the invention the holes extend through the port plates. Rotation of the control ring in one or the opposite directions opens or closes the holes to increase or decrease fluid flow, as the case may be, through the check valves to the discharge port.

Means are provided for preventing fluid leakage through the holes past the vane tips and for preventing rapid wear of said tips.

DESCRIPTION OF THE INVENTION

Figure 1:
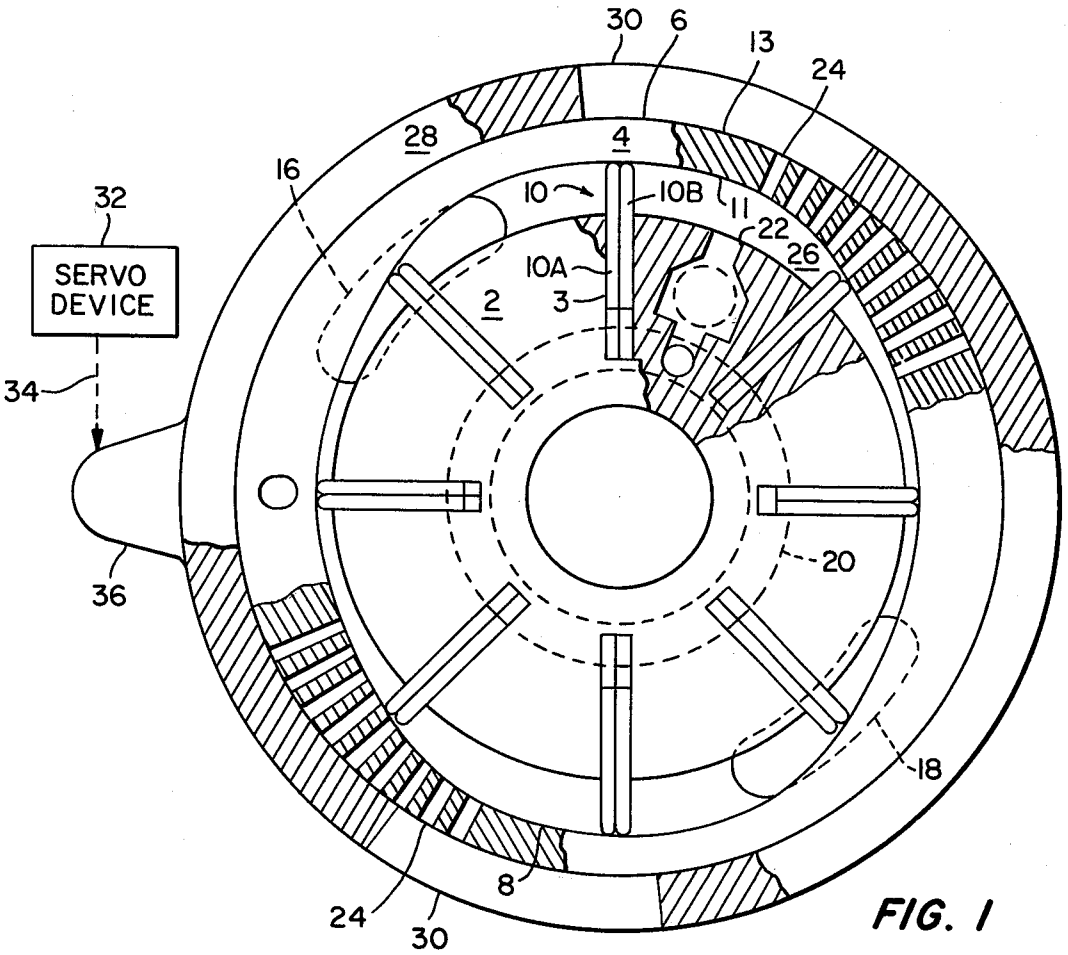
FIG. 1 is a diagrammatic plan view showing one embodiment of the disclosed invention wherein an alternate fluid flow passage from the pump discharge zone to the pump inlet zone is provided.
Figure 2:
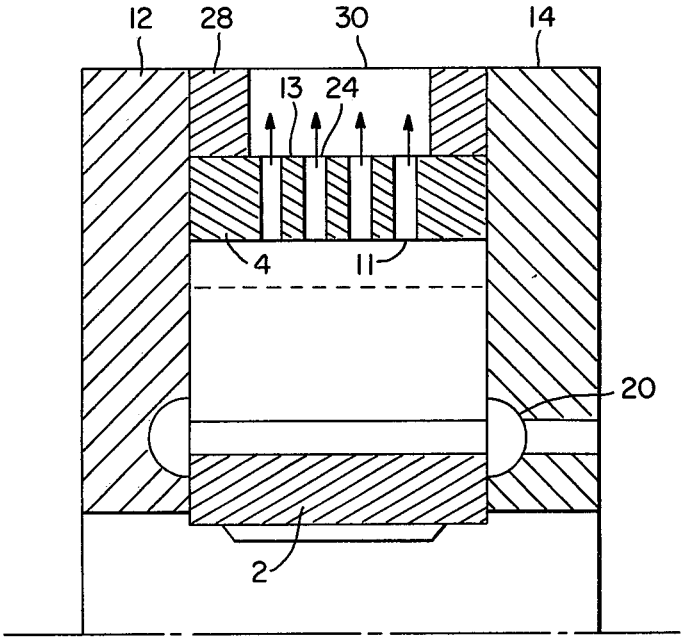
FIG. 2 is a sectional view of the configuration shown in FIG. 1.

With reference to FIGS. 1 and 2, the variable displacement balanced vane pump herein disclosed includes a rotor 2 which is arranged for rotation in a cam ring 4 having two diametrically opposed lobes 6 and 8. A plurality of slots 3 are equidistantly disposed around rotor 2. Each slot 3 has disposed therein a vane 10 including a plurality of integral vane numbers, shown for illustration purposes as two in number and carrying the designation 10A and 10B.

Port plates 12 and 14 (FIG. 2) have formed therein diametrically opposed inlet ports 16 and 18 and an annular outlet or discharge port 20 as shown in FIG. 1. As will be understood by those skilled in the art, vanes 10 and port plates 12 and 14 are held firmly against cam ring 2 by the pump discharge pressure acting on associated spring biasing means (not shown).

A plurality of check valves such as that designated by the numer 22 (FIG. 1), and which may be conventional ball type check valves, are built in rotor 2 between adjacent vanes 10 and permit flow radially inward to annular discharge port 20.

Cam ring 4 carries a plurality of radially extending through holes 24, which are in communication with an intervane chamber 26. A control ring 28 is in close diametrical fit with the outer circumference 13 of cam ring 4 and includes diametrically opposed by-pass ports 30, one of which is shown in FIGS. 1 and 2.

Flow of fluid is normally in through inlet ports 16 and 18 and out via check valves 22 through discharge port 20. An alternate flow passage for fluid being compressed in intervane chamber 26 is via holes 24 and by-pass ports 30 as shown by the arrows in FIG. 2. Holes 24 are partially or fully blocked for controlling flow of fluid therethrough to by-pass ports 30 by the counterclockwise or clockwise rotation of control ring 28.

Thus, if control ring 28 is rotated counterclockwise (FIG. 1), all of the holes 24 may be blocked and flow to check valves 22 and therethrough to discharge port 20 i.e., from the pump inlet zone to the pump discharge zone, will be at a maximum. If control ring 28 is rotated clockwise, holes 24 are progressively opened to create the aforenoted alternate fluid flow passage. The creation of the alternate fluid flow passage, reduces discharge fluid flow as will now be understood.

In this connection it is noted that control ring 28 is rotated by a conventional type servo device 32 coupled by suitable mechanical means 34 to a node 36 integral with control ring 28.

Although only one side of the pump arrangement has been illustrated and described, the diametrically opposite side is identical to preserve the aforenoted balanced conditions. It will be understood that discharge port 20 is arranged to supply discharge pressure to the underside of vanes 10 as is necessary to maintain the vanes in contact with cam ring 4.

Figure 6:
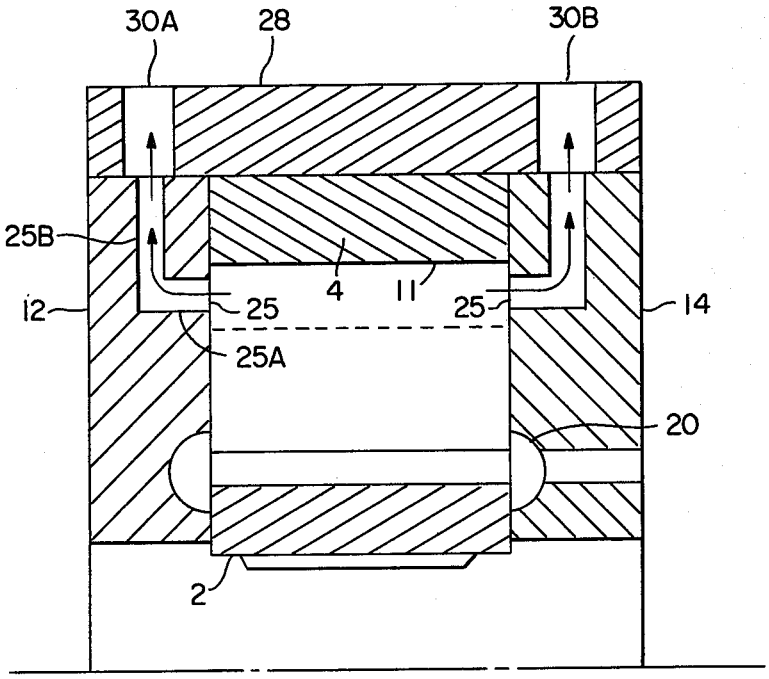
FIG. 6 is a sectional view showing another embodiment of the invention wherein an alternate fluid flow passage from the pump discharge zone to the pump inlet zone is provided.

Another embodiment of the invention for providing the aforenoted alternate fluid flow passage is illustrated in FIG. 6. Thus, with port plates 12 and 14, cam ring 4 and control ring 28 arranged as shown, the port plates carry holes 25 having axially extending portions 25A in communication with intervane space 26 (FIG. 1) and radially extending portions 25B. Control ring 28 carries a plurality of by-pass ports shown as two in number and designated as 30A and 30B. Rotation of control ring 28 as aforenoted brings the radially extending portions of holes 25 into or out of communication with by-pass ports 30A, 30B to increase or decrease discharge fluid flow through valves 22 as heretofore described. Fluid flow is as shown by the arrows. The diametrical opposite side of the pump arrangement may be identical to preserve the desired balanced conditions as aforenoted. The arrangement of FIG. 6 is advantageous in that more than one by-pass port is provided in the same control ring area as will now be understood.

Figure 3:
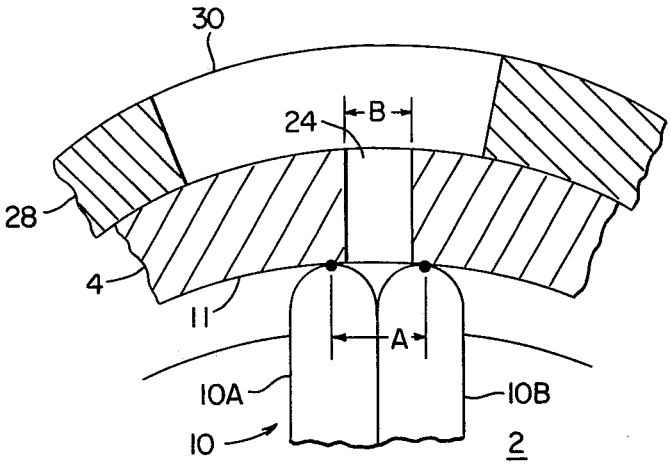
FIG. 3 is an enlarged diagrammatic representation showing the disposition of the lines of contact between the cam ring and vanes shown in FIGS. 1 and 2.

As best shown in FIG. 3, vanes 10 including integral vane members 10A and 10B extend to the inner circumference 11 of the cam ring 4 as heretofore noted with reference to FIG. 1. It will be seen that the circumferential distance (A) between the vane/cam ring contact lines of vane members 10A, 10B is greater than the diameter (B) of holes 24. This insures that a line of contact, forming a seal, is at all times interposed between discharge and inlet pressure zones and prevents internal pump leakage. Thus, integral vane members 10A and 10B insure that there will always be a vane surface contacting the cam ring and therefore providing a seal from high and low pressures as are likely to occur. In this connection it is noted that although two integral vane members 10A and 10B have been shown and described for illustration purposes, the number of such members required will depend on the size of holes 24.

Figure 4:
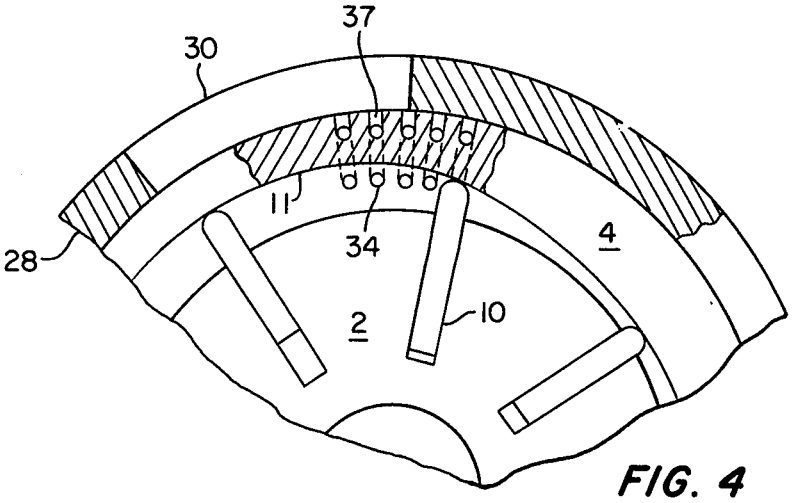
FIG. 4 is a partial diagrammatic plan view showing an embodiment of the invention featuring an alternative routing of the by-pass fluid flow.
Figure 5:
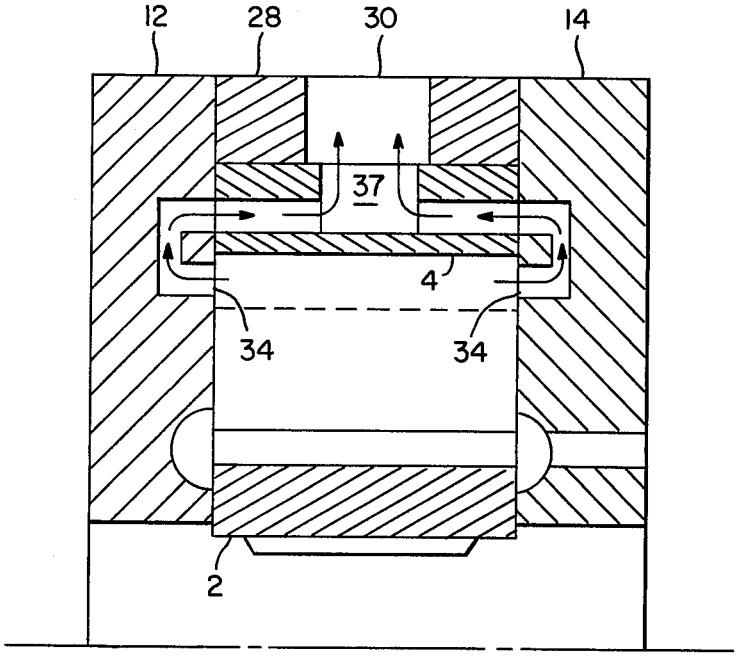
FIG. 5 is a sectional view of the configuration shown in FIG. 4.

With particular reference to the embodiment of the invention shown in FIGS. 4 and 5, it will be understood that for pump vanes 10 to function properly at the pressures involved, a film of fluid must be maintained at the vane tip to prevent metal to metal contact with the vane tip and inner circumference 11 of cam ring 4 which is likely to result in vane wear. It has been found that the arrangement of axial holes 24 in cam ring 4 (FIGS. 1 and 2) contributes to the destruction of this film and causes rapid wear of the vane tips.

In order to accommodate this situation, port plates 12 and 14 are modified to carry axial holes 34 which are in communication with radial slots 37 carried by cam ring 4, which are in turn in communication with by-pass port 30, in the zone in which the fluid is being compressed, whereby the required fluid film is maintained. A pair of axial holes 34 is best shown in FIG. 5 with the ends of said holes being shown in FIG. 4. Fluid flow is as shown by the arrows. In this modified form, vane members 10A, 10B are not required and a single vane per rotor slot 3 will suffice for the purposes of the invention if the thickness of the vane is greater than the diameter of hole 34 as illustrated in FIG. 4.

It will now be seen from the aforenoted description of the invention with reference to FIGS. 1–6 that a variable displacement balanced vane pump has been provided which includes an alternate flow passage for fluid being compressed in an intervane chamber, whereby the excess portion of the fluid is by-passed from the pump discharge zone to the pump inlet zone without appreciably increasing the pressure of the excess fluid portion and thereby minimizing the required pump input energy. An arrangement is described wherein each vane 10 is arranged as an integral plurality of vane members to insure a seal from fluid flow at high and low pressures through holes 24, and another arrangement is described wherein wear of the vane tips that would otherwise occur is alleviated.

What is claimed is:

1. A variable displacement balanced vane pump, comprising:

a cam ring having a pair of diametrically opposed lobes;

a rotor rotatable in the cam ring and having a plurality of radially extending slots spaced equidistantly therearound;

a plurality of vane means disposed in the slots and extending to the inner circumference of the cam ring;

a rotatable control ring in close diametrical fit with the outer circumference of the cam ring;

a pair of port plates sandwiching the rotor and cooperating to provide a pair of diametrically opposed inlet ports and an annular discharge port;

valves carried by passages in the rotor in the space between adjacent vane means and permitting fluid flow radially inward from the inlet ports to the discharge port;

means for rotating the control ring;

means associated with the cam ring and the control ring for providing an alternate fluid flow passage and for thereby regulating fluid flow through the valve upon rotation of the control ring;

said last-mentioned means comprising a first plurality of radially extending holes carried by one portion of the cam ring, a second corresponding plurality of radially extending holes carried by a diametrically opposite portion of the cam ring, the first and second pluralities of holes being in communication with corresponding spaces between the vane means, the control ring carrying a pair of diametrically opposed by-pass ports, and the alternate fluid flow passage being provided upon rotation of the control ring which brings the by-pass ports carried thereby in communication with the first and second pluralities of holes carried by the cam ring; and the circumference of the contact line between the vane means and the inner circumference of the cam ring being greater than the diameter of the holes in the first and second pluralities of holes to insure a seal with the inner circumference of the cam ring which prevents fluid leakage via the holes in the first and second pluralities of holes past the vane means tips when the vane means tips are adjacent said holes.

2. A variable displacement balanced vane pump as described by claim 1, wherein:

rotation of the cam ring in one sense brings the by-pass ports progressively out of communication with the holes in the first and second pluralities of holes to reduce fluid flow through the alternate fluid flow passage, whereby fluid flow through the valves is regulated to be at a maximum; and rotation of the cam ring in the opposite sense brings the by-pass ports progressively into communication with the holes in the first and second pluralities of holes to increase fluid flow through the alternate fluid flow passage, whereby fluid flow through the valves is regulated to be at a minimum.

* * * * *